US011046102B2

(12) United States Patent
Cantrell et al.

(10) Patent No.: US 11,046,102 B2
(45) Date of Patent: Jun. 29, 2021

(54) INK TANK CAP AND VALVE LINKAGE

(71) Applicant: HEWLETT-PACKARD DEVELOPMENT COMPANY, L.P., Spring, TX (US)

(72) Inventors: John J. Cantrell, Vancouver, WA (US); Keith Jariabka, Vancouver, WA (US); Theodore J. Conley, Vancouver, WA (US); William S. Osbome, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/499,255

(22) PCT Filed: Oct. 20, 2017

(86) PCT No.: PCT/US2017/057742
§ 371 (c)(1),
(2) Date: Sep. 28, 2019

(87) PCT Pub. No.: WO2019/078898
PCT Pub. Date: Apr. 25, 2019

(65) Prior Publication Data

US 2020/0238742 A1 Jul. 30, 2020

(51) Int. Cl.
*B41L 27/04* (2006.01)
*B41J 2/175* (2006.01)

(52) U.S. Cl.
CPC ..... *B41L 27/04* (2013.01); *B41J 2/17513* (2013.01); *B41J 2/17523* (2013.01); *B41J 2/17553* (2013.01)

(58) Field of Classification Search
CPC ... B41L 27/04; B41J 2/17513; B41J 2/17523; B41J 2/17553; B41J 1/00
See application file for complete search history.

(56) References Cited

U.S. PATENT DOCUMENTS 6,036,305 A 3/2000 Nagasaki et al.
6,367,918 B1 4/2002 Heiles et al.
(Continued)

FOREIGN PATENT DOCUMENTS

CN 201176026 1/2009
CN 101583494 11/2009
CN 201889955 7/2011

OTHER PUBLICATIONS

IP.com search (Year: 2020).*

*Primary Examiner* — Lisa Solomon
(74) *Attorney, Agent, or Firm* — HP Inc. Patent Department

(57) ABSTRACT

An example ink tank includes an ink tank and a cap assembly attached to the ink tank with a preloaded hinge. The hinge rotates the cap assembly from a closed position to an open position when the cap assembly is unlatched. The cap assembly includes a bung to seal the ink tank during a partial rotation of the cap assembly when the cap assembly is unlatched. The ink tank also includes spring-loaded linkage connected to a valve in the ink tank. An effector extending from the cap assembly engages the spring-loaded linkage when the cap assembly is latched and disengages from the spring-loaded linkage after the cap assembly is unlatched. The spring-loaded linkage opens the valve when engaged with the effector, and closes the valve when disengaged from the effector, while the bung maintains a tank seal until the internal valve is closed.

15 Claims, 13 Drawing Sheets

(56) References Cited

U.S. PATENT DOCUMENTS

| | | | |
|---|---|---|---|
| 6,550,899 | B1 | 4/2003 | Cowger et al. |
| 7,114,801 | B2 | 10/2006 | Hall et al. |
| 7,878,632 | B2 | 2/2011 | Kachi |
| 8,052,255 | B2 | 11/2011 | Nishida |
| 8,348,364 | B2 | 1/2013 | Taga |
| 2003/0169318 | A1 | 9/2003 | Kline et al. |
| 2005/0151799 | A1 | 7/2005 | Kosciesza |
| 2008/0158283 | A1 | 7/2008 | Tsai et al. |
| 2008/0231676 | A1 | 9/2008 | Shimizu |
| 2015/0191020 | A1 | 7/2015 | Tominaga et al. |

* cited by examiner

INK TANK CAP AND VALVE LINKAGE

BACKGROUND

Printers are commonplace, whether in a home environment or an office environment. Such printers can include laser printer, inkjet printers or other types. Generally, printers require at least one consumable, such as paper or ink. Ink may be provided for the printers in cartridges that may be replaceable or refillable.

BRIEF DESCRIPTION OF THE DRAWINGS

For a more complete understanding of various examples, reference is now made to the following description taken in connection with the accompanying drawings in which.

DETAILED DESCRIPTION

Bubbler-style ink tanks for inkjet printers require a seal at the ink fill port during printing to create and maintain the negative back pressure required to prevent excessive ink flow due to gravity when the ink supply is located above the print head assembly. Breaking the seal to fill the ink tank may result in ink drool or flooding at the print head assembly.

To address the issues described above, various examples provide for linking the cap and valve actuations of external and internal seals of an ink tank. The linkage facilitates sealing of a valve in the ink tank before an external seal is broken and negative backpressure in the ink tank is lost. In one example, when an ink tank is opened for filling, the cap of the ink tank is automatically forced to a first, partially opened position by a pre-loaded hinge, while the cap remains sealed and the valve is actuated (i.e., closed). In some examples, the cap includes an effector that actuates the valve through the linkage.

Accordingly, the present disclosure describes example apparatus, methods and systems to facilitate the linked activation of cap and valve seals of an ink tank.

In one example, an apparatus includes an ink tank and a cap assembly attached to the ink tank with a preloaded hinge to rotate the cap assembly from a closed position to an open position. The rotation of the cap assembly may occur when the cap assembly is unlatched. The cap assembly of the example apparatus may include a bung to seal the ink tank during a partial rotation of the cap assembly when the cap assembly is unlatched. The example apparatus may further includes a spring-loaded linkage connected to a valve in the ink tank. An effector may extend from the cap assembly to engage and actuate the spring-loaded linkage when the cap assembly is latched and to disengage from the spring-loaded linkage after the cap assembly is unlatched. The spring-loaded linkage opens the valve when engaged with the effector, and closes the valve when disengaged from the effector. The bung maintains a tank seal until the internal valve is closed. An example apparatus is described below with reference to FIG. 1.

Figure 1:
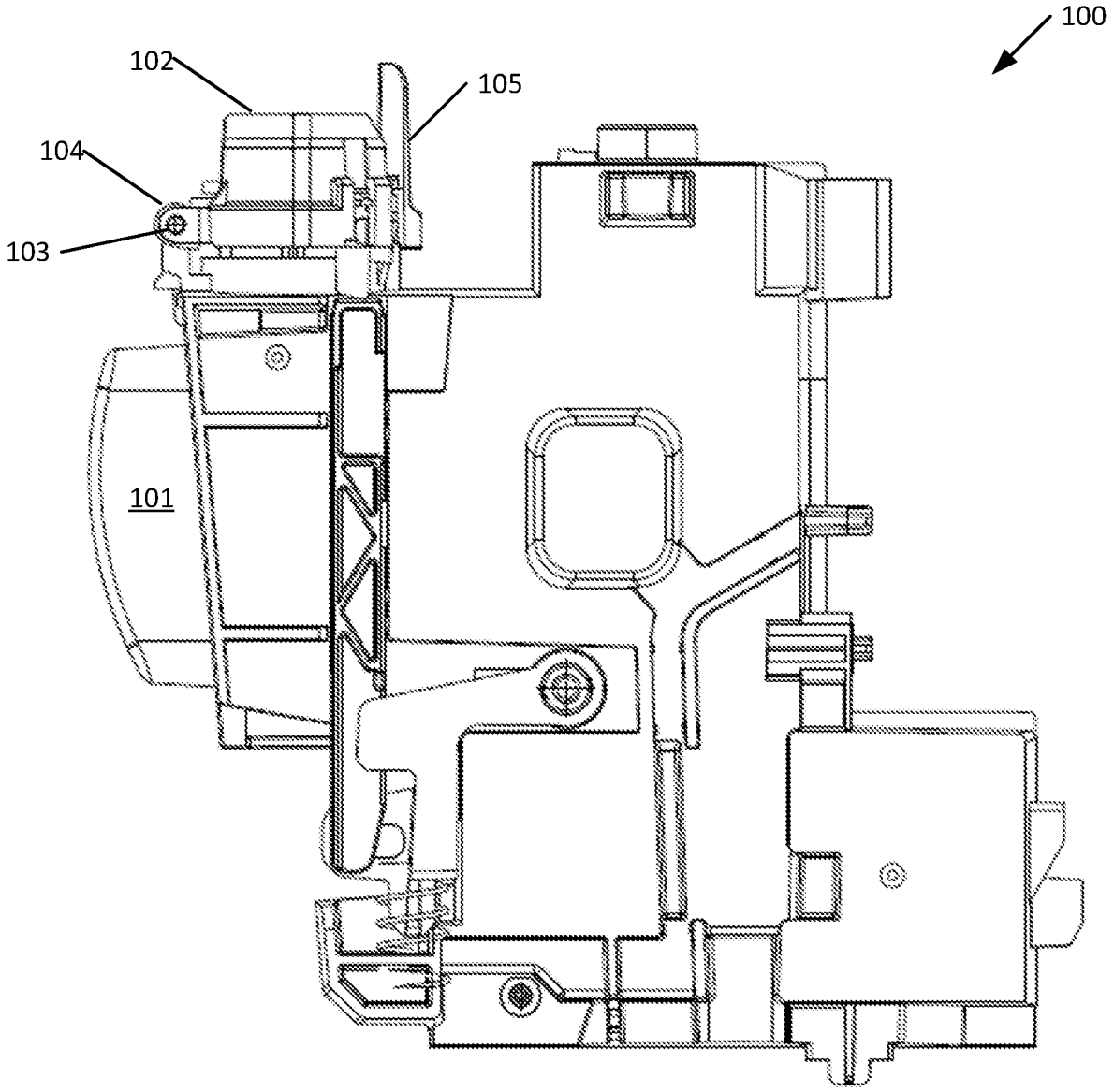
FIG. 1 is a side view of an example ink tank.

Referring now to the figures, FIG. 1 illustrates a side view of an example ink tank 100. Example ink tank 100 includes an ink tank body 101, which may be a multi-chambered ink tank as described in greater detail below. The example ink tank 100 also includes a cap assembly 102 attached to the ink tank 100 with a hinge, such as hinge 103 illustrated in FIG. 1, which may be preloaded. In the example illustrated in FIG. 1, the cap assembly 102 is shown in a latched (closed) state. Cap assembly 102 may be attached to the example ink tank 100 by the hinge 103. Hinge 103 may be any type of hinge that constrains the rotation of the cap assembly 102 to a single axis of rotation. In one example, hinge 103 may be an axle engaged with cylindrical bearings extending from the cap assembly 102. In one example, hinge 103 may be preloaded with an elastic band 104 disposed around the hinge 103 to apply an opening force to the cap assembly 102, such that when the cap assembly 102 is unlatched, the opening force applied by the elastic band 104 rotates the cap assembly 102 to a fully opened position and maintains the cap assembly 102 in the fully opened position until the force is overcome by force applied by a user to close the cap assembly 102.

Example ink tank 100 also includes a latch 105 to hold the cap assembly 102 in a closed position against the opening force applied by the elastic band 104 as illustrated in FIG. 1. Accordingly, the cap assembly 102 is constrained to two stable states: a closed state (closed position) as illustrated in FIG. 1 when the latch 105 is engaged, and a fully opened state (fully opened position) when the latch is released, as described and illustrated below.

Figure 3:
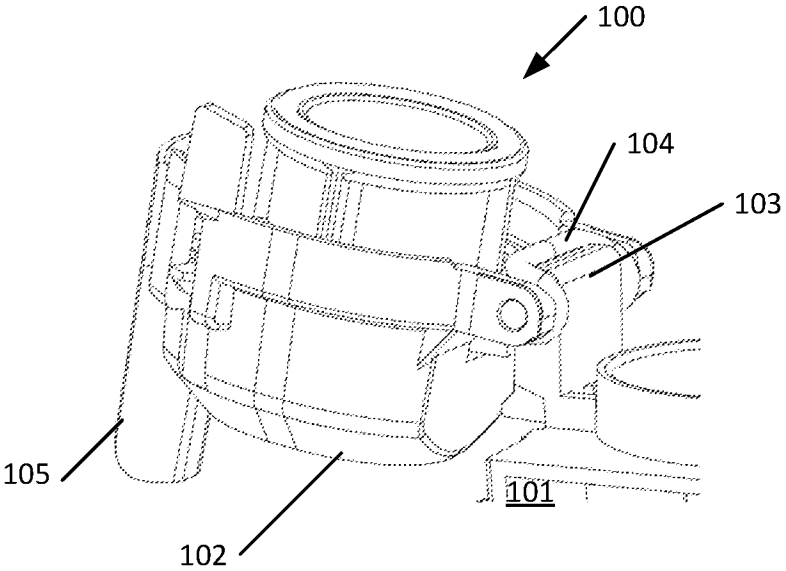
FIG. 3 is a perspective illustration of an example ink tank with an open cap.
Figure 2:
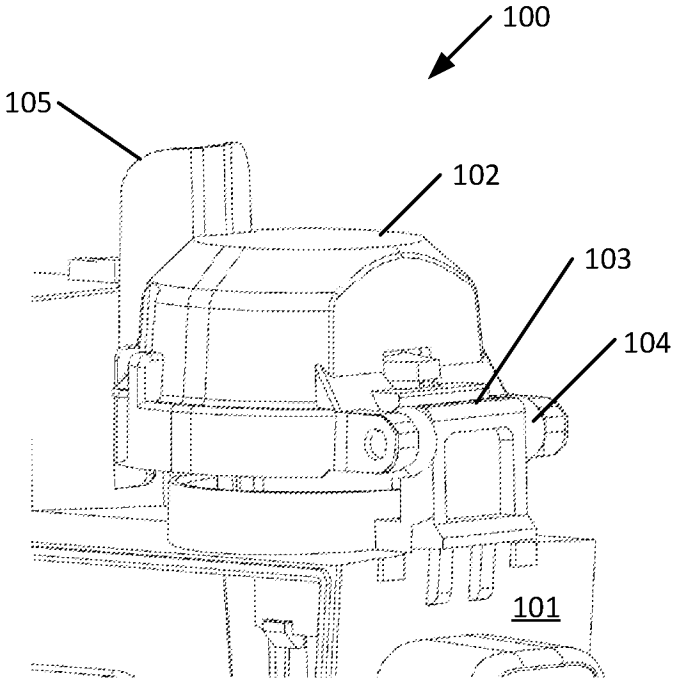
FIG. 2 is a perspective illustration of an example ink tank with a closed cap.

For greater clarity in describing the disposition and function of the elastic band 104, FIG. 2 is a perspective illustration of the ink cap assembly 102 in the closed position, and FIG. 3 is a perspective illustration of the example ink tank 100 with the cap assembly 102 in the fully opened position. It will be appreciated from these views that the elastic band 104 wraps around the ends of the axle of hinge 103 (as illustrated in FIG. 3) and under the arms of the hinge 103 (as illustrated in FIG. 3) to force to the cap assembly 102 to the fully open position as illustrated in FIG. 3.

Figure 4:
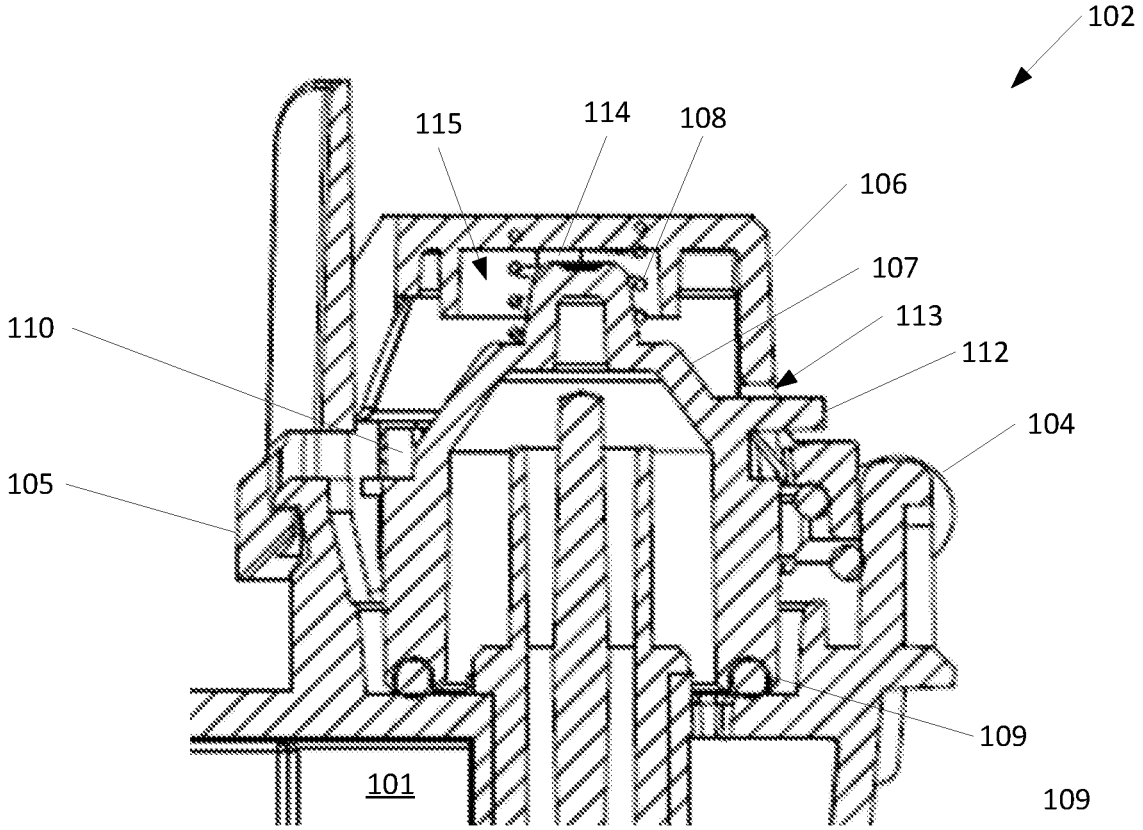
FIG. 4 is a sectional view of an example cap assembly in a closed position.
Figure 5:
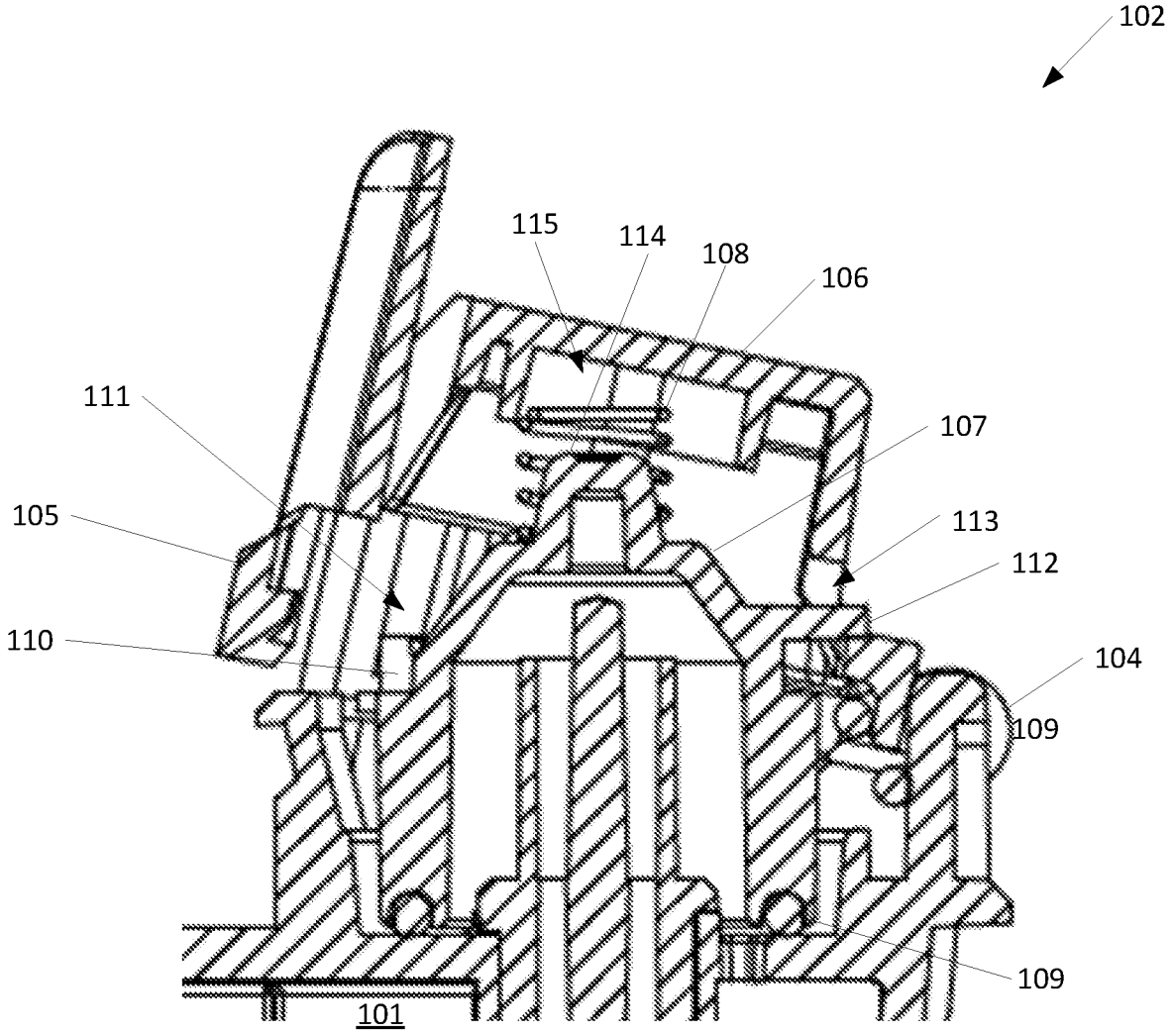
FIG. 5 is a sectional view of an example cap assembly in a partially opened position.

FIG. 4 is a sectional view of an example cap assembly 102 illustrating internal details of cap assembly 102 in the closed position, and FIG. 5 is a sectional view illustrating the cap assembly 102 of FIG. 4 in a transient, partially open state after the cap assembly 102 has been unlatched by the operation of latch 105. As illustrated in FIG. 4, the cap assembly includes a cap housing 106, a bung 107 retained within the cap housing 106, and a spring 108 disposed between the cap housing 106 and the bung 107. In one example, and without limitation, cap housing 106 may be fabricated from an acetal homopolymer thermoplastic such as Delrin,® and the bung 107 may be fabricated from a natural or synthetic elastic polymer such as natural rubber or silicone rubber. Also shown in FIG. 4 are the ink tank body 101 (partial), the elastic band 104, and the latch 105, previously described.

In the closed (latched) position illustrated in FIG. 4, the spring 108 is compressed between the cap housing 106 and the bung 107 and applies a sealing force between the bung 107 and the ink tank body 101. In one example, the bung 107 may include an O-ring 109 to improve the seal between the bung 107 and the ink tank body 101. As shown in FIG. 4, the bung 107 is retained within cap housing 106 by a number of complementary features comprising tabs or protuberances from the bung 107 and openings, cavities or channels in the cap housing 106. These include tab 110 of the bung 107 in a channel 111 of the cap housing (hidden in FIG. 4 but visible in FIG. 5), tab 112 of the bung 107 in opening 113 of the cap housing 106, and crown 114 of the bung 107 in cavity 115 of the cap housing 106. It will be appreciated that these complementary features will allow for relative motion between the cap housing 106 and the bung 107 when the cap assembly 102 is unlatched, as described below.

As noted, FIG. 5 is a sectional view illustrating the cap assembly 102 of FIG. 4 in a transient, partially open state after the cap assembly 102 has been unlatched by the operation of latch 105. This transient state is achieved by the combined forces of spring 108 and hinge 104. When latch 105 is released, spring 108 applies a force to push the cap housing 102 away from the bung 107 while maintaining a sealing force between the bung 107 and the ink tank body 101. It will be appreciated that this force decreases as spring 108 decompresses and that the relative motion of the cap housing 106 and the bung 107 is limited by the complementary features of the cap assembly 106 and the bung 107 described above.

In the transient state shown in FIG. 5, tab 112 is constrained by opening 113, the crown 114 (with spring 108) has moved within cavity 115, and tab 110 has reached the lower bound of channel 111, which limits further relative motion between the cap housing 106 and the bung 107. In one example, described in greater detail below, this transient position serves to actuate a valve in the ink tank (using other features of the cap housing 102) to effect a secondary seal in the ink tank body 101 before the seal between the bung 107 and the ink tank body 101 is broken. After the cap assembly 102 reaches the transient position illustrated in FIG. 5, further motion of the cap assembly 102 is controlled by the force applied to the cap assembly 102 by the elastic band 104. As described previously, this force rotates the cap assembly to a fully open position.

Figure 6:
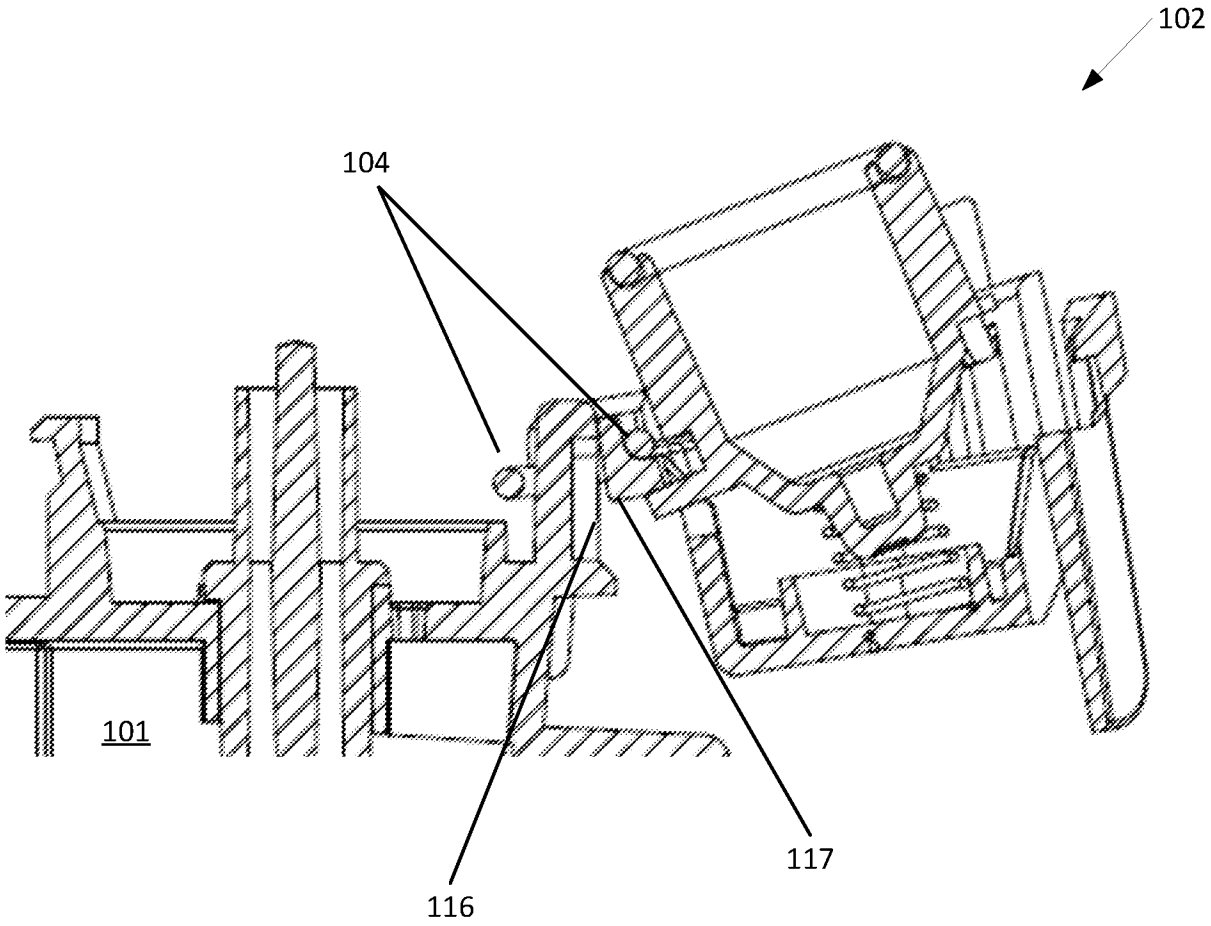
FIG. 6 is a sectional view of an example cap assembly in a fully opened position.

FIG. 6 is a sectional view illustrating the cap assembly 102 of FIGS. 4 and 5 in the fully open state. In this state, further rotation is limited by interference between a sidewall 116 of the ink tank body 101 and a flange 117 of the hinge 103 (not visible in FIG. 6).

Figure 7:
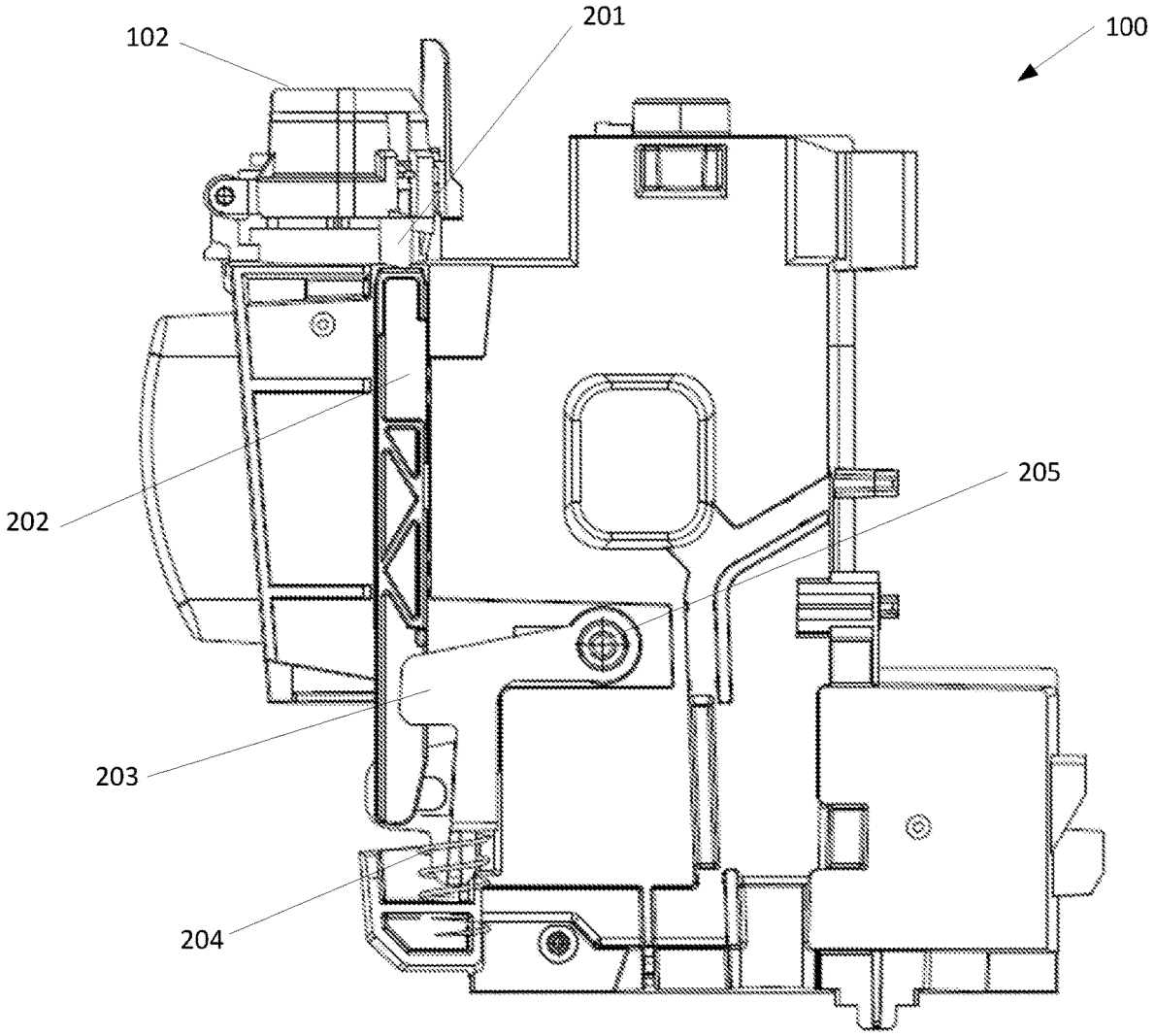
FIG. 7 is a side view of an example ink tank.

Turning now to a description of the secondary sealing mechanism referenced above with respect to the opening of the cap assembly 102, FIG. 7 illustrates the side view of the example ink tank 100 previously illustrated in FIG. 1. In the example of FIG. 7, the cap assembly 102 is in the closed (latched) state. In this state, an effector 201 (an extension of cap assembly 102) extends downward from the cap assembly 102 to depress a slider 202, which is retained in a channel in the body of the ink tank 100. The slider may be retained by any means known in the art, such as by channels or tabs, for example. In this position, the slider 202 is engaged with a cam on lever arm 203 that is spring loaded by a spring 204, and holds the lever arm 203 in a downward position against the force of the spring 204. Lever arm 203 is fixed to a rotatable spline 205 that extends into the interior of the ink tank body 101. In one example, spline 205 may be held in place by a snap-ring or c-clip, and sealed by an O-ring or the like as it passes through the wall of the ink tank body 101.

Figure 8:
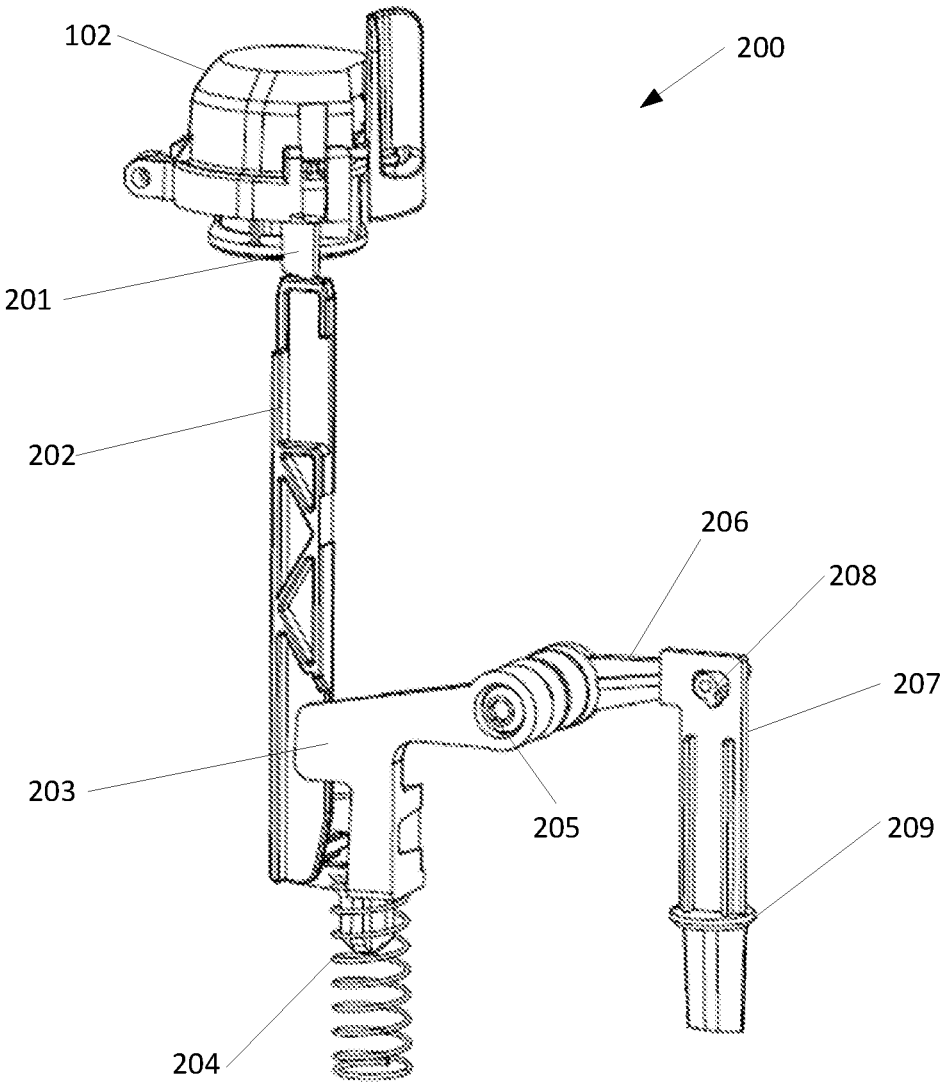
FIG. 8 is a perspective illustration of an example valve linkage.

FIG. 8 is a perspective illustration of the linkage described above, in isolation, showing additional details not visible in FIG. 7. In FIG. 8, the sealed pinion 205 is fixed to a second lever arm 206, which in turn is connected to a valve body 207 by a pin 208 that is fixed with respect to lever arm 206 and free to rotate with respect to valve body 207. Valve body 207 includes a valve seal 209 that is configured to provide a seal when seated in a valve seat 210 in the ink tank (see FIG. 9). It will be appreciated that in the closed cap configurations illustrated in FIG. 7 and FIG. 8, the lever arm 203 is held in a downward rotated position by the slider 202, that lever arm 206 is held in an upward rotated position by its fixed connection to lever arm 203 via spline 205, and that the valve assembly comprising valve seal 209 and valve seat 210 is held open.

Figure 9:
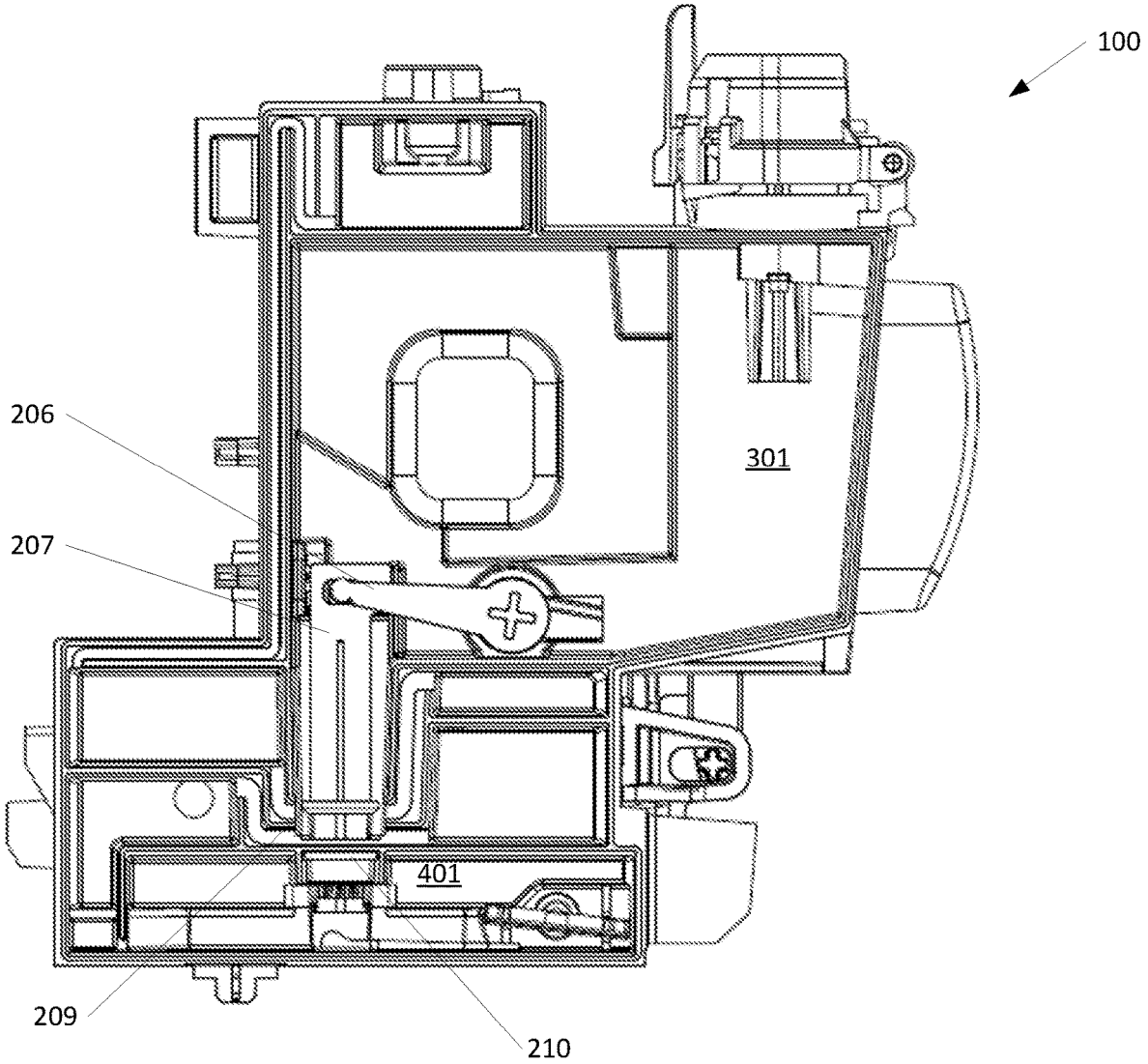
FIG. 9 is a sectional view of an example ink tank with a closed cap.

FIG. 9 is a partial sectional (cutaway) view of the example ink tank 100, showing internal details of the ink tank and the valve linkage described above in the closed cap configuration. In FIG. 9, lever arm 206 is in its upward rotated position, which translates through valve body 207 to an unseated valve seal 209. Also illustrated in FIG. 9 is an upper chamber 301 of ink tank body 101, and a lower chamber 401 of ink tank body 101, also referred to as a feeder tank. The valve assembly is positioned between the upper chamber 301 and the lower chamber 401 and permits fluid commination between the upper chamber 301 and the lower chamber 401.

Figure 10:
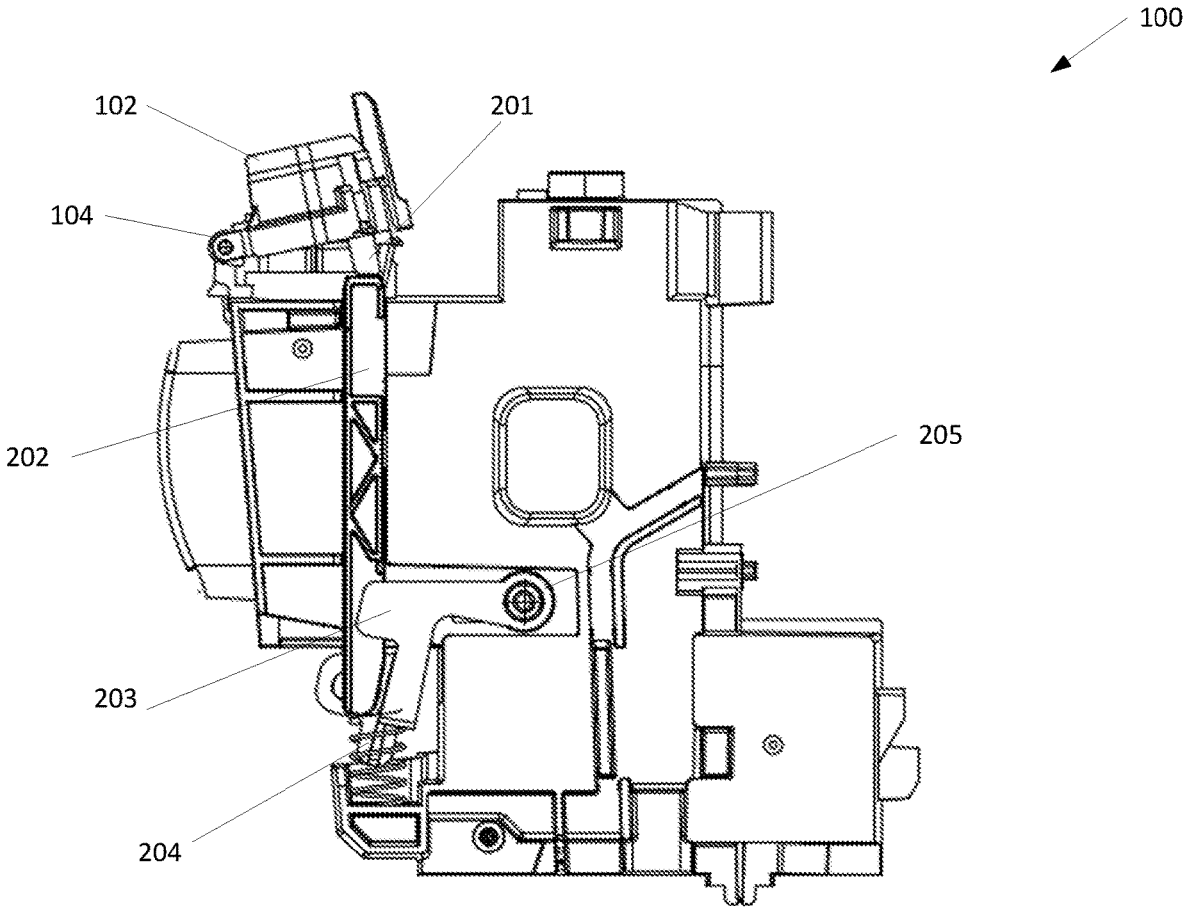
FIG. 10 is a side view of an example ink tank with a partially open cap.

Turning now to FIG. 10, there is illustrated a side view of the example ink tank 100 with the cap in the transient, partially open state described above. In this transient state, the cap assembly 102 is partially open, such that the cap housing 106 is partially rotated and the bung (107) to ink tank (101) seal is maintained, but the holding force applied by effector 201 is removed from slider 202, which allows the force of spring 204 to rotate lever arm 203 upward (clockwise in FIG. 10). In one example, the angle of rotation of the cap assembly 102 relative to the closed position may be in the range of approximately 10 to 14 degrees.

Figure 11:
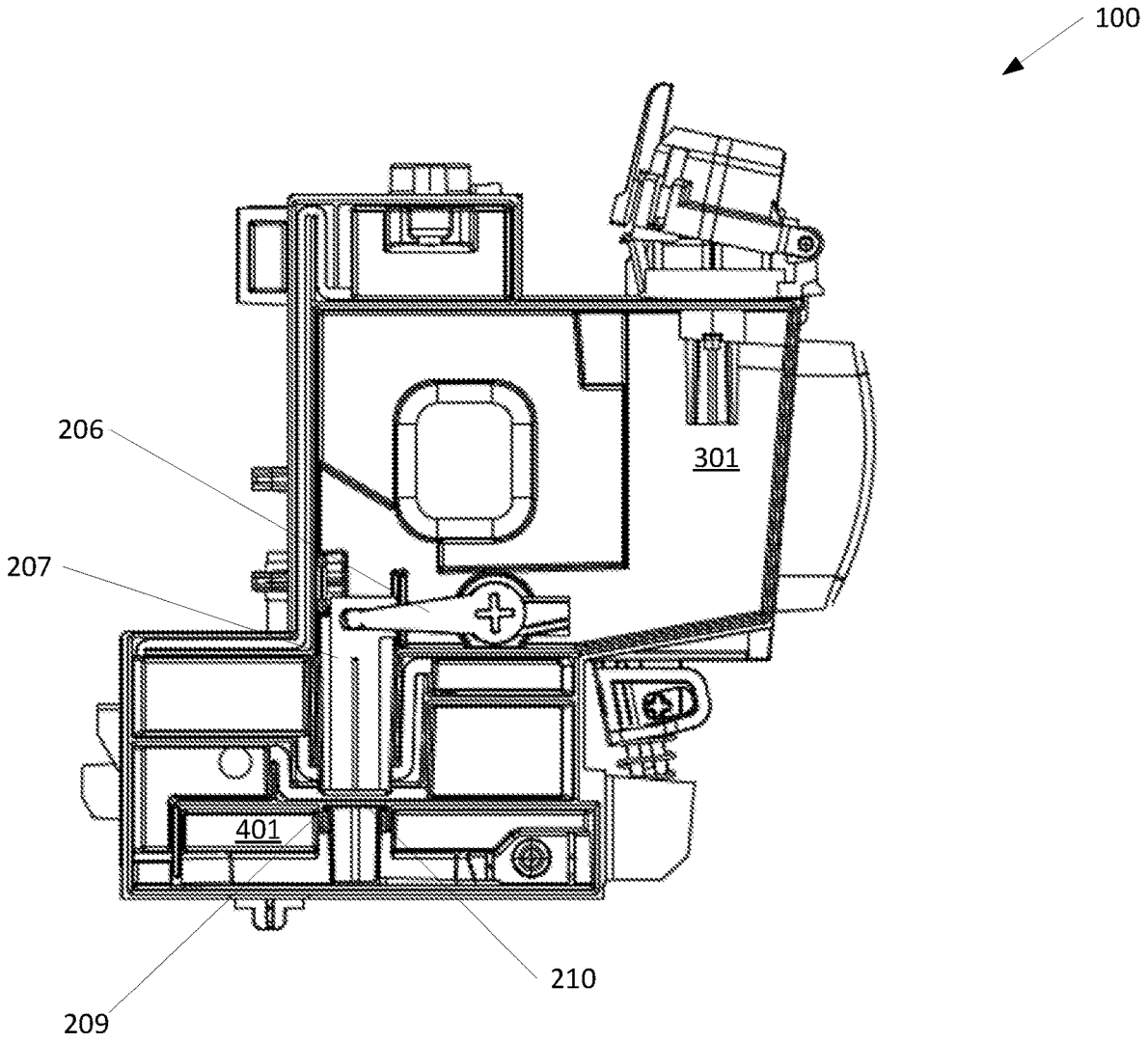
FIG. 11 is a sectional view of an example ink tank with a partially open cap.

FIG. 11 is a partial sectional (cutaway) view of the example ink tank 100, showing internal details of the ink tank and the valve linkage described above in the transient, partially open cap state. In FIG. 11, lever arm 206 is rotated downward, which translates through valve body 207 to seat valve seal 209 into value seat 210, thereby providing a seal between upper chamber 301 and lower chamber 401 and preventing fluid communication between the upper chamber 301 and the lower chamber 401.

Figure 12:
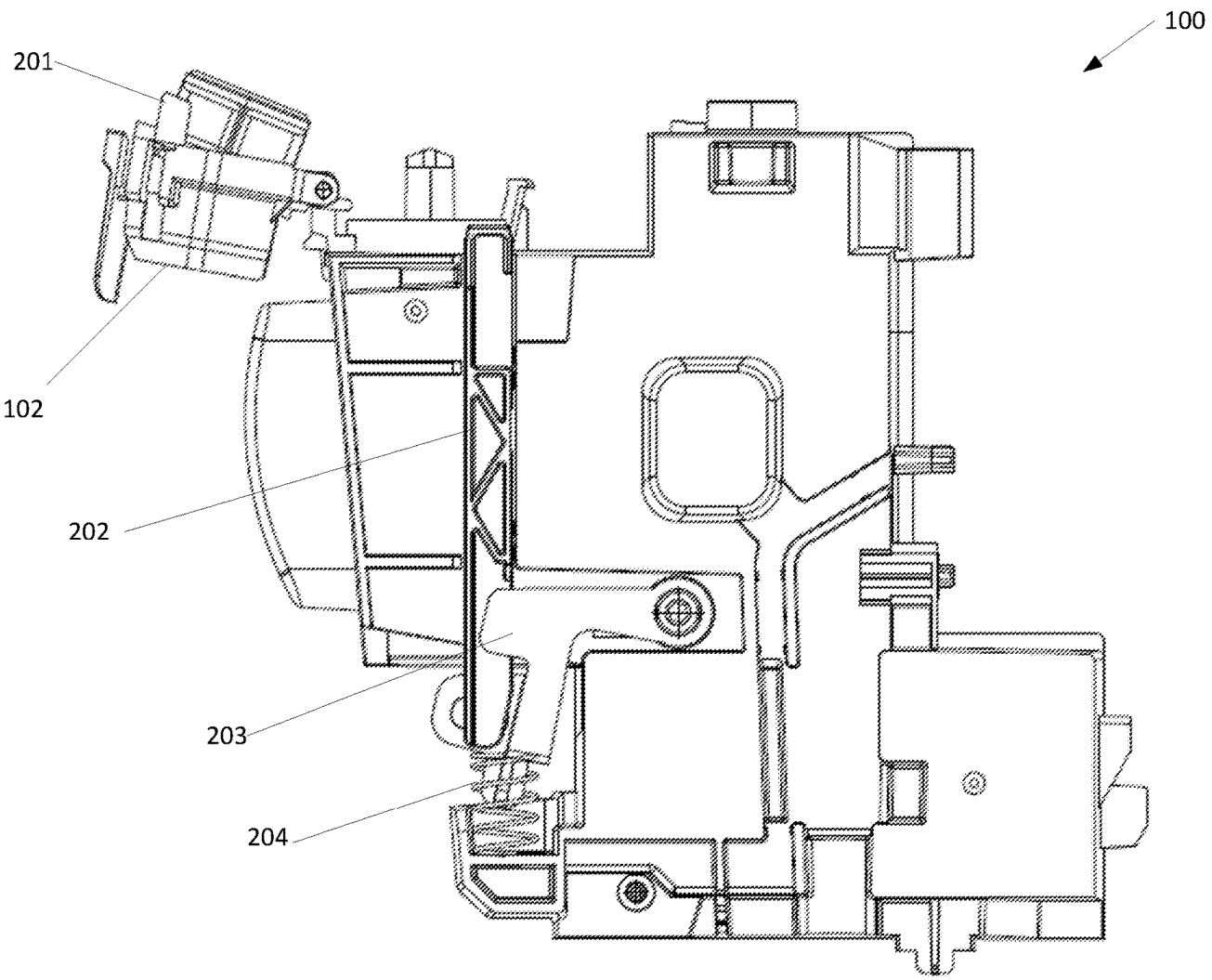
FIG. 12 is a side view of an example ink tank with a fully opened cap.

FIG. 12 illustrates the example ink tank 100 with the cap assembly rotated to its fully opened position under the force applied by the elastic band 104 described above. It will be appreciated that the internal seal between valve seal 209 and valve seat 210 will be maintained as the cap assembly 102 rotates from the transient position to the fully opened position because the effector 201 remains disengaged from the slider 202, allowing the spring 204 to hold the lever arm 203 in its upward rotated position. As described above, this position of lever arm 203 corresponds to the seating of valve seal 209 in valve seat 210.

The seal between the upper chamber 301 and the lower chamber 401 isolates the upper chamber to prevent gravitationally induced pressure from causing ink drool at the print head assembly.

From the foregoing description, it will be appreciated that the sequence of events that occurs when the cap is opened is reversible when the cap assembly 102 is closed by a user. Between the fully opened state and the transient state, the internal valve is closed and the upper chamber 301 of ink tank body 101 is not sealed by the bung 107. When the cap assembly reaches the transient position, the bung (107) seals the upper chamber 301 of ink tank (101) and the effector 201 engages the slider 202. From the transient position to the closed position, the effector 201 depresses slider 202, which rotates lever arm 203 downward and lever arm 206 upward to unseat valve seal 209 from valve seat 210, reestablishing fluid communication between upper chamber 301 of ink tank body 101 and lower chamber 401 of ink tank body 101.

Figures 13, 14:
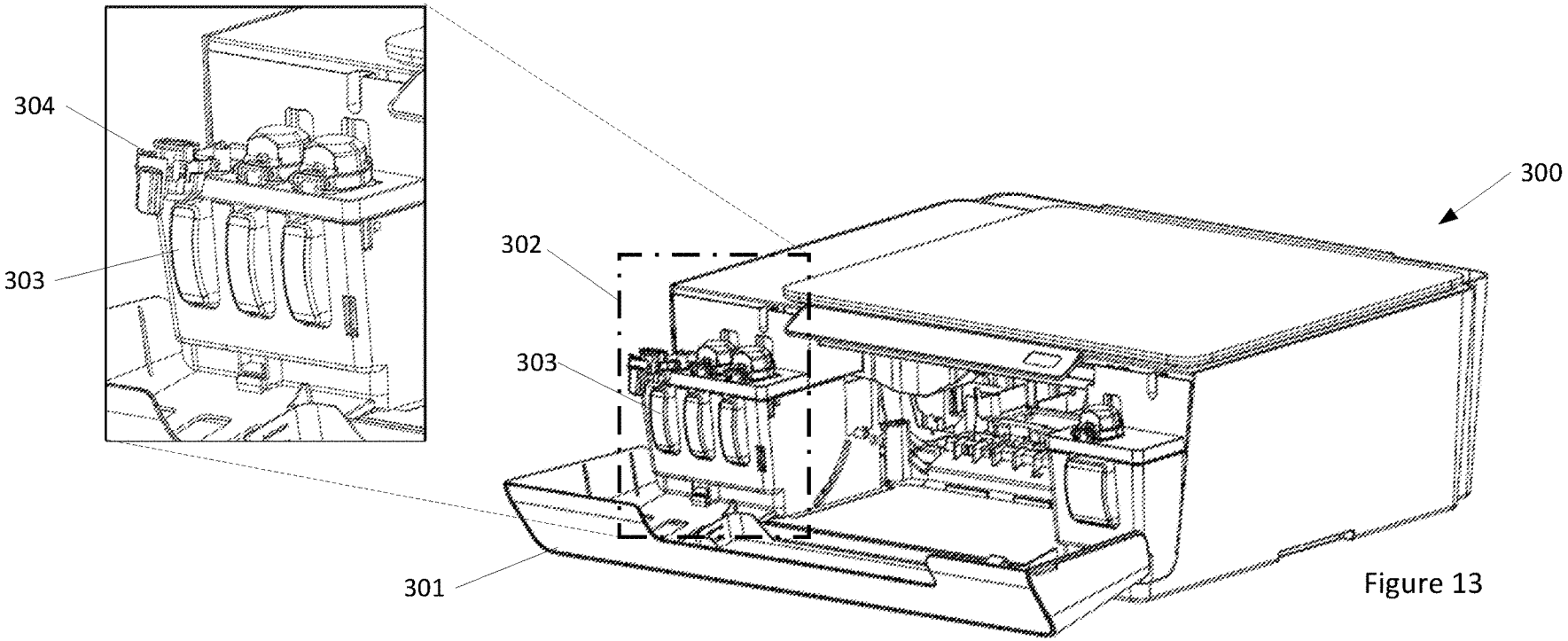
FIG. 13 is a perspective illustration of an example printing system.
FIG. 14 is a magnified view of an example ink tank bay in the printing system illustrated in FIG. 13.

FIG. 13 illustrates an example printer system 300 with an access door 301 in an open position to allow access to an ink tank bay 302 containing at least one ink tank, such as example ink tank 303, for filling or refilling. FIG. 14 is a magnified view of the ink tank bay 302 illustrating one of the example ink tanks 303 and a cap assembly 304 in a fully opened position. The example ink tank 303 and the cap assembly 304 may be similar to the example ink tank 100 and cap assembly 102 described above with reference to FIGS. 1-12. In this regard, the cap assembly 304 is attached to the ink tank with a preloaded hinge to rotate the cap assembly 304 from a closed position to an open position when the cap assembly 304 is unlatched. The cap assembly 304 of FIG. 14 may include a bung to seal the ink tank during a partial rotation of the cap assembly 304 when the cap assembly 304 is unlatched. A spring-loaded linkage may be provided and may be connected to a valve in the ink tank. An effector may extend from the cap assembly 304 to engage and actuate the spring-loaded linkage when the cap assembly 304 is latched and to disengage from the spring-loaded linkage after the cap assembly 304 is unlatched. The spring-loaded linkage opens the valve when engaged with the effector, and closes the valve when disengaged from the effector. The bung maintains a tank seal until the internal valve is closed.

Figure 15:
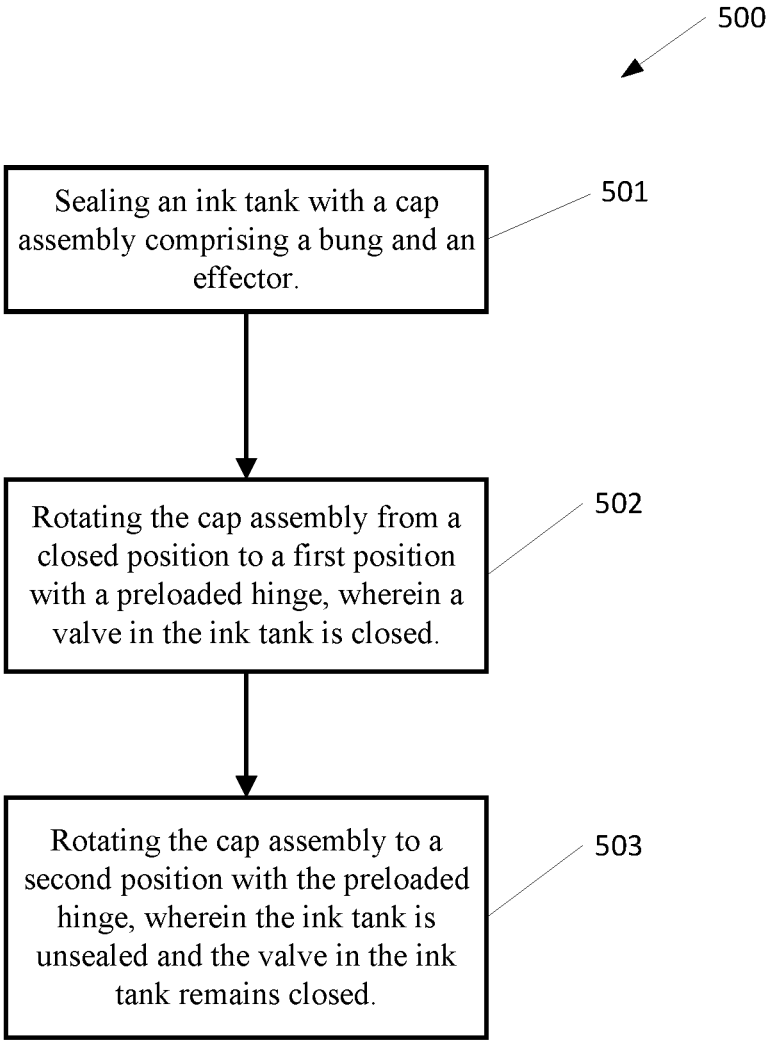
FIG. 15 is a flowchart illustrating an example method for sequencing internal and external seals.

Referring now to FIG. 15, a flowchart illustrates an example method 500 for linking cap and valve actuation in an ink tank. The example method includes sealing an ink tank with a cap assembly comprising a bung and an effector, such as cap assembly 102 in FIG. 4 illustrating bung 107, and cap assembly 102 in FIG. 7 illustrating effector 201 (block 501). Example method 500 further includes rotating the cap assembly from a closed position to a first position with a preloaded hinge to close a valve in the ink tank (block 502). For example, FIG. 10 illustrates cap assembly 102 rotated by hinge 104 to a first, partially rotated position to disengage effector 201 from the external linkage comprising slider 202, external lever arm 203, hinge 204, and sealed spline 205. FIG. 11 illustrates the internal linkage comprising lever arm 206, valve body 207, and valve seal 209 seated in valve seat 210 to seal (close) the valve. Finally, example method 500 includes rotating the cap assembly to a second position with the preloaded hinge, where the ink tank is unsealed and the valve in the ink tank remains closed (block 503). For example, FIG. 12 illustrates cap 102 rotated to a second, fully opened position where the effector 102 is disengaged from the linkage described above, and the linkage is in the same position as in FIG. 10, corresponding to a closed valve Thus, in accordance with various examples described herein, linking the actuation of the external cap and internal valve of an ink tank during ink filling operations insures that a valve internal to the ink tank is sealed before an external seal is broken and negative backpressure in the cartridge's ink tank is lost.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described to explain the principles and the nature of various examples of the present disclosure and its practical application to enable one skilled in the art to use the present disclosure in various examples and with various modifications as are suited to the particular use contemplated. The features of the examples described herein may be combined in all possible combinations of methods, apparatus and systems.

It is also noted herein that while the above describes examples, these descriptions should not be viewed in a limiting sense. Rather, there are several variations and modifications which may be made without departing from the scope as defined in the appended claims.

What is claimed is:

1. An apparatus, comprising:

an ink tank;

a cap assembly rotatably attached to the ink tank with a preloaded hinge, the preloaded hinge to rotate the cap assembly from a closed position to an open position when the cap assembly is unlatched, the cap assembly comprising a housing, a bung retained within the housing, and a spring disposed between the housing and the bung to bias the bung to form a seal with the ink tank during a partial rotation of the cap assembly when the cap assembly is unlatched;

a spring-loaded linkage connected to a valve in the ink tank;

an effector extending from the cap assembly to engage and actuate the spring-loaded linkage when the cap assembly is latched and to disengage from the spring-loaded linkage after the cap assembly is unlatched, wherein the spring-loaded linkage opens the valve when engaged with the effector, and closes the valve when disengaged from the effector, and wherein the bung maintains the seal with the ink tank until the valve is closed by the spring-loaded linkage.

2. The apparatus of claim 1, wherein the ink tank comprises an upper chamber and a lower chamber and the valve therebetween, the valve comprising a valve body, a valve seal and a valve seat.

3. The apparatus of claim 2, wherein the spring-loaded linkage comprises:

a first lever arm external to the ink tank;

a second lever arm internal to the ink tank and coupled to the valve;

a sealed spline fixed to the first lever arm and the second lever arm;

a spring to bias the first lever arm; and a slider to be engaged by the effector and to engage the first lever arm.

4. The apparatus of claim 3, wherein the spring is operative to bias the valve to a closed position when the effector is disengaged with the slider, wherein fluid communication between the upper chamber and the lower chamber is prevented.

5. The apparatus of claim 3, wherein the slider is operative to open the valve when the effector is engaged with the slider, wherein fluid communication between the upper chamber and the lower chamber is enabled.

6. A method, comprising:

sealing an ink tank with a cap assembly rotatably attached to the ink tank, the cap assembly comprising a housing, a bung retained within the housing, and a spring disposed between the housing and the bung to bias the bung to form a seal with the ink tank during a partial rotation of the cap assembly when the cap assembly is unlatched;

partially rotating the cap assembly from a closed position to a first position with a preloaded hinge, wherein the bung maintains the seal with the ink tank until a valve in the ink tank is closed; and further rotating the cap assembly to a second position with the preloaded hinge, wherein the ink tank is unsealed and the valve in the ink tank remains closed.

7. The method of claim 6, further comprising: rotating the cap assembly from the second position to the first position, wherein the ink tank is resealed and the valve remains closed; rotating the cap assembly from the first position to the closed position, wherein the valve is opened and the ink tank remains sealed.

8. The method of claim 6, wherein when the cap assembly is in the closed position, an effector extending from the cap assembly engages a valve linkage that opens the valve.

9. The method of claim 8, wherein when the cap assembly is between the first position and the second position, the effector disengages the valve linkage.

10. The method of claim 9, wherein the valve is biased to a closed position by the valve linkage.

11. A system, comprising:

an ink tank bay;

at least one ink tank installed in the ink tank bay, each ink tank comprising:

an ink tank body;

a cap assembly rotatably attached to the ink tank body with a preloaded hinge, the preloaded hinge to rotate the cap assembly from a closed position to an open position when the cap assembly is unlatched, the cap assembly comprising a housing, a bung retained within the housing, and a spring disposed between the housing and the bung to bias the bung to form a seal with the ink tank during a partial rotation of the cap assembly when the cap assembly is unlatched;

a spring-loaded linkage connected to a valve in the ink tank;

an effector extending from the cap assembly to engage and actuate the spring-loaded linkage when the cap assembly is latched and to disengage from the spring-loaded linkage after the cap assembly is unlatched, wherein the spring-loaded linkage opens the valve when engaged with the effector, and closes the valve when disengaged from the effector, and wherein the bung maintains the seal with the ink tank until the valve is closed by the spring-loaded linkage.

12. The system of claim 11, wherein the ink tank comprises an upper chamber and a lower chamber and the valve therebetween, the valve comprising a valve body, a valve seal and a valve seat.

13. The system of claim 12, wherein the spring-loaded linkage comprises:

a first lever arm external to the ink tank;

a second lever arm internal to the ink tank and coupled to the valve;

a sealed spline fixed to the first lever arm and the second lever arm;

a spring to bias the first lever arm; and a slider to be engaged by the effector and to engage the first lever arm.

14. The system of claim 13, wherein the spring is operative to bias the valve to a closed position when the effector is disengaged with the slider, wherein fluid communication between the upper chamber and the lower chamber is prevented.

15. The system of claim 13, wherein the slider is operative to open the valve when the effector is engaged with the slider, wherein fluid communication between the upper chamber and the lower chamber is enabled.

* * * * *